US008939563B2

(12) United States Patent
Platt et al.

(10) Patent No.: US 8,939,563 B2
(45) Date of Patent: Jan. 27, 2015

(54) SWAGED FILTER SANDWICH AND WEIR PLATE

(71) Applicant: Xerox Corporation, Norwalk, CT (US)

(72) Inventors: David Paul Platt, Newberg, OR (US); Joseph Andrew Broderick, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/778,740

(22) Filed: Feb. 27, 2013

(65) Prior Publication Data

US 2014/0240416 A1 Aug. 28, 2014

(51) Int. Cl.
*B41J 2/175* (2006.01)

(52) U.S. Cl.
CPC ..... *B41J 2/17563* (2013.01)
USPC ..... 347/93

(58) Field of Classification Search
CPC ..... B41J 2/17563
USPC ..... 347/93
See application file for complete search history.

(56) References Cited

U.S. PATENT DOCUMENTS

| | | | | |
|---|---|---|---|---|
| 2005/0146582 | A1* | 7/2005 | Platt et al. | 347/87 |
| 2007/0139498 | A1* | 6/2007 | Chikamoto et al. | 347/93 |
| 2008/0122901 | A1* | 5/2008 | Platt et al. | 347/85 |

* cited by examiner

*Primary Examiner* — Stephen Meier
*Assistant Examiner* — Alexander D Shenderov
(74) *Attorney, Agent, or Firm* — Marger Johnson & McCollom PC

(57) ABSTRACT

A filter plate has an interior cavity, at least one filter contained in the interior cavity, a first port on a first side of the plate, at least one second port on a second side of the plate, forming a flow path with the first port through the filter, wherein the second port is positioned higher on the plate than the first port. A print head has an ink reservoir having an ink supply port connected to an ink supply, and a filter plate attached to the reservoir and positioned between the ink supply port and the ink reservoir, the filter plate including an interior cavity, at least one filter contained in the interior cavity, a first filter port on a first side of the filter plate in contact with the ink supply port, and at least one second filter port on a second side of the filter plate facing the ink reservoir, wherein the second port is positioned higher on the filter plate than the first port.

4 Claims, 4 Drawing Sheets

SWAGED FILTER SANDWICH AND WEIR PLATE

BACKGROUND

Ink jet printers generally transport ink from an ink reservoir into a jet stack, a stack of plates that form manifolds and a pressure chamber. The ink flows through the manifolds to the pressure chamber, essentially a very small reservoir. A transducer of some sort receives an electrical signal and pushes the ink out of the pressure chamber through a nozzle to strike a printing substrate. Transporting the ink requires control over the flow rate of the ink. Dispensing the ink onto a substrate with good image quality requires that there not be any air bubbles or foreign matter in the ink that would affect the amount of ink dispensed or the integrity of the color of the ink.

Generally, controlling the flow of ink involves a weir plate. A weir plate typically controls the flow of a fluid by slowing the flow of the fluid until it reaches a bather, causing the fluid to pool up behind the plate and then eventually reach the outlet. The weir plate usually resides in the print head in a point in the flow path prior to reaching the jet stack. To remove air bubbles and foreign matter, the ink flows through a filter. The filter generally consists of two layers, one of stainless steel mesh and one of stainless steel felt.

The weir plate and the filters typically reside in the ink flow path as separate pieces. This involves attaching the two filter layers and then adding an additional weir plate after the filter. This involves three separate adhesive joints, and the additional weir plate. The added complexity to the print head increases the costs and the adhesive joints contribute possible points of failure in the printhead.

DETAILED DESCRIPTION OF THE EMBODIMENTS

Figure 1:
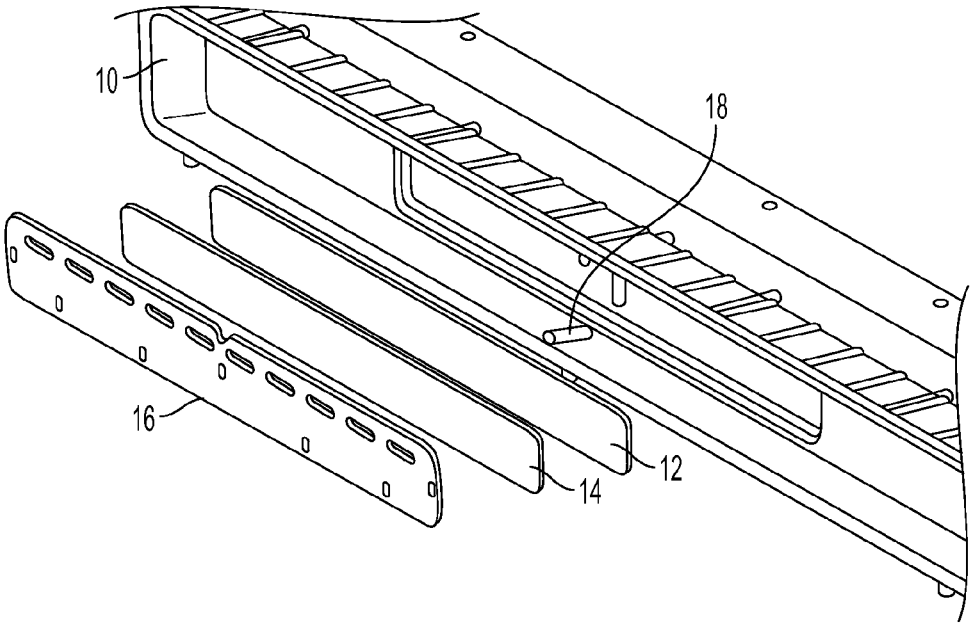
FIG. 1 PRIOR ART
FIG. 1 shows a prior embodiment of a print head having two filters and a weir plate.

As discussed previously, current approaches to filtering ink in a print head typically use three adhesive joints, one each for each of the filters and one for the weir plate. FIG. 1 shows an example of this. A print reservoir 10 receives ink through the back wall via an umbilical, not shown, from an ink supply. In some instances, the ink supply resides in another part of the printer housing than the print head. The umbilical attaches to the back side of the print head reservoir and the ink enters the reservoir through an ink supply port 18.

In the example shown, the filters and weir plate reside inside the print reservoir against the interior surface of the back wall. In the example shown, there is a recess that receives the filters 12 and 14 and the weir plate 16. As will be seen in other examples, the reservoir may not have a recess to accommodate the filter and plate, but instead may have alignment features that allow for fast and properly aligned placement of the plate or plates.

Each of these structures, 12, 14 and 16, must be adhered to the reservoir or each other independently. This involves three adhesive joints, one for each structure. This increases both the manufacturing complexity, which may increases the time and costs to produce the print head, and the number of possible points of failure in operation of the print head. The failure of the joints may result in introduction of particles into the ink flow, as well as adversely affect the pressure within the reservoir. The ink is typically pressurized to assure smooth flow out of the print head onto the print substrate and breaks in these joints may adversely affect that pressure.

Figure 2:
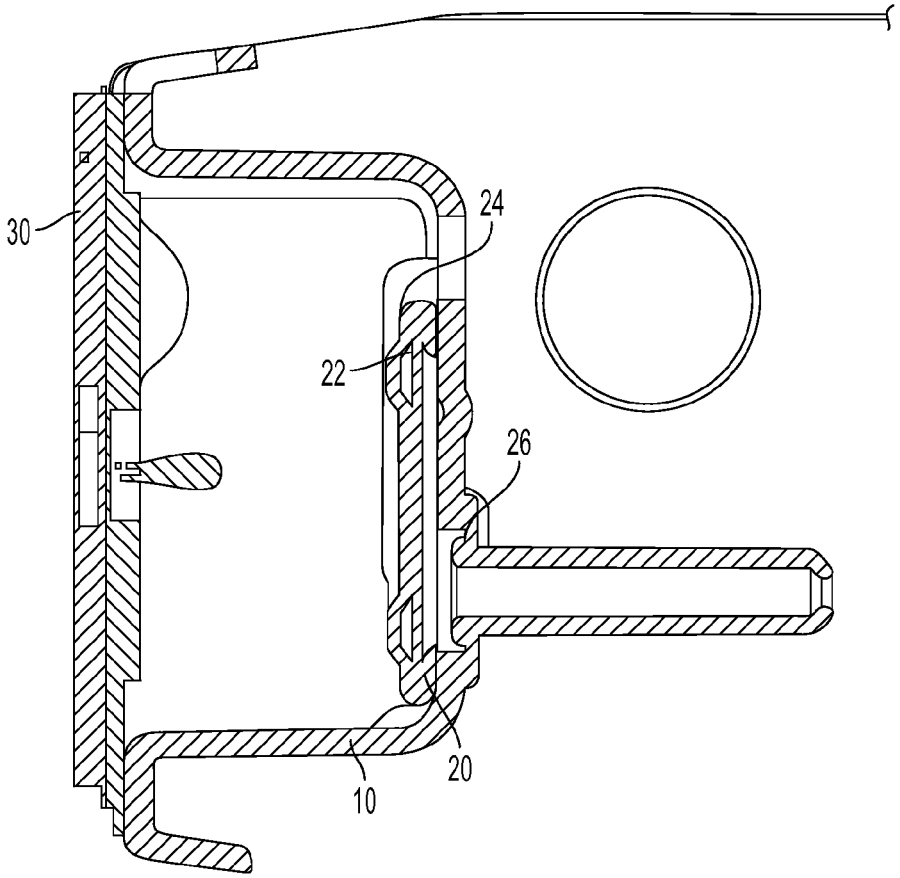
FIG. 2 shows an embodiment of a sandwich filter plate within a print head.

FIG. 2 shows an embodiment of a combined weir plate and filter structure, referred to here as a 'filter sandwich' or a filter sandwich plate. The plate may consist of at least one filter swaged into a plate to form a single structure. This structure is then attached to the printer reservoir, also referred to as the reservoir plate, 10 usually at the back wall.

The print head reservoir 10 receives ink through the ink supply port 26 into the filter plate 20. The ink travels through the filter or filters 22 and exits the filter plate through upper slots such as 24, which may be more easily seen in further pictures. After passing through the filter plate, the ink at least partially fills the reservoir formed between the reservoir plate 10 and the jet stack 30. The jet stack 30 has openings, not shown, to allow the ink to exit the reservoir into the jet stack. The jet stack ultimately routes the ink to a set of jets or nozzles that will deposit the ink on the substrate. The jet stack forms the final wall of the reservoir.

Figure 3:
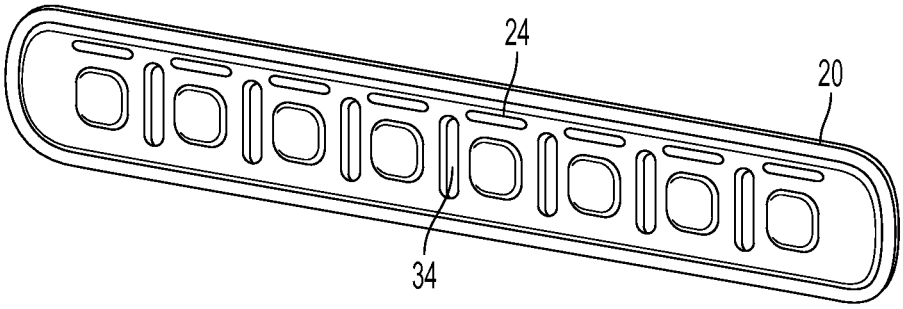
FIG. 3 shows an embodiment of a weir plate used in a filter sandwich plate.

FIG. 3 shows a perspective view of an embodiment of a filter plate 20. The filter plate in this figure is oriented with the face of the plate that points towards the reservoir cavity being shown. The ink path in this embodiment would travel from the upper right hand corner, through the ink supply port not seen from this perspective, into the filter sandwich plate and then exits the filter sandwich plate through the weir slots such as 24.

Figure 4:
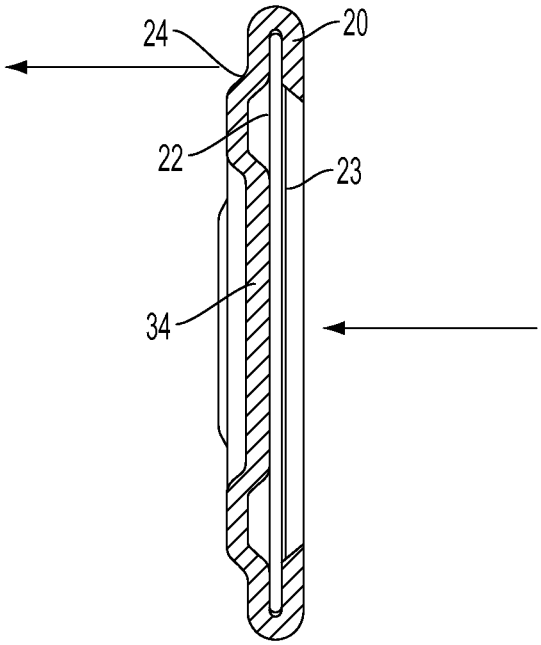
FIG. 4 shows a side view of an embodiment of a filter sandwich plate with the filters.

The weir plate portion of the filter sandwich plate may include dimples such as 34. As can be seen in FIG. 4, the dimples such as 34 act as a standoff for the filter or filters inside the plate. This prevents formation of an ink meniscus in the filter, which would form if the filter were flush to the wall. The formation of a meniscus would require extra pressure to overcome the meniscus and to allow the ink to continue to flow.

As a further flow control feature, the weir slots will typically reside higher in the filter sandwich plate than the incoming ink supply port, with the ink flow shown by the arrows in FIG. 4. The ink 'pools' or slows down behind the weir plate as it makes it path through the filter to the weir slots, providing extra control over the flow path of the ink.

In the embodiments shown here, the filters are 'swaged' or fit into the filter sandwich between two plates that are sealed together. While swaging is shown here, these plates may be mechanically bonded together and will typically be hermetically sealed by many different means including adhesives, brazing, soldering, etc. The filter sandwich may hold one or more filters, depending upon the filter used and the desired filtering results. In the embodiments of FIG. 4, a first filter of stainless steel mesh 23 is followed by a second first of stainless steel felt 22 in the ink path. One filter may remove particulates and the other air bubbles, one filter may remove both, etc.

Figure 5:
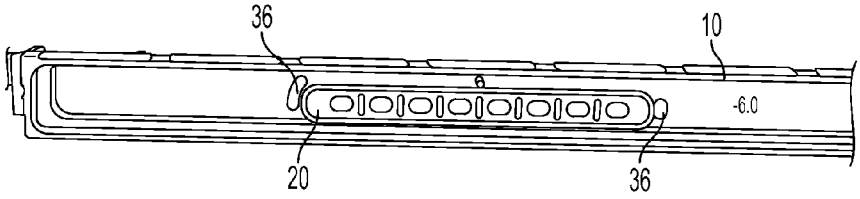
FIG. 5 shows an embodiment of a print reservoir wall having a sandwich filter plate.

Returning to FIG. 1, one can see that the print reservoir plate 10 included a recess into which the filters and weir plate resided as separate structures. That embodiment of a reservoir plate may also be used with the filter sandwich. FIG. 5 shows an alternative receiving structure for the filter sandwich. In FIG. 5, the print reservoir plate 10 includes features 36 that guide the proper placement of the filter sandwich 20 as well as possibly provide some mechanical support to the bond between the surface of the back wall of the print reservoir plate 10 and the filter sandwich 20.

Figure 6:
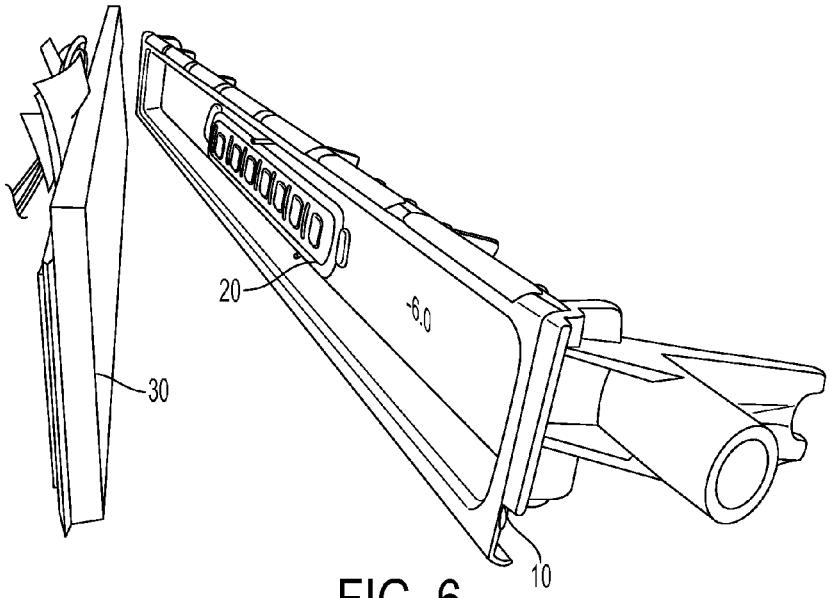
FIG. 6 shows an embodiment of a print head prior to the attachment of the jet stack to the print reservoir wall.

FIG. 6 shows a side perspective view of the print reservoir plate 10 with the filter sandwich in place just prior to attachment of the jet stack. In the perspective, one can see the depth of the cavity formed in the print reservoir plate 10. This cavity fills with the ink that exits the filter sandwich plate. The jet stack 30 forms the final wall of the cavity. Once the ink reaches a sufficient level in the cavity, it will flow into the jet stack 30 and ultimately out of the print head to the print substrate, such as a piece of paper or other print material.

In this manner, two of the adhesive joints previously used have been eliminated. This reduces possible points of failure in the operation of the print head if those other two seals were to be breached. It also eliminates the steps of having to apply the extra adhesive. While the manufacture of the filter sandwich may increase the number of steps, the filter sandwich may be manufactured simultaneously with other steps prior to attachment. This avoids increasing the time it takes to assemble the print head.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print head, comprising:

an ink reservoir having an ink supply port connected to an ink supply; and a filter plate attached to the reservoir using only one adhesive joint and positioned between the ink supply port and the ink reservoir, the filter plate comprising:

two plates sealed together;

an interior cavity formed between the two plates;

at least one filter contained in the interior cavity;

a first filter port on a first side of the filter plate in contact with the ink supply port;

at least one second filter port on a second side of the filter plate facing the ink reservoir, wherein the second port is positioned higher on the filter plate than the first port.

2. The print head of claim 1, further comprising a structure on an interior wall of the ink reservoir positioned adjacent to the ink supply port, the structure configured to receive the filter plate.

3. The print head of claim 1, wherein the filter plate is attached to the ink reservoir with an adhesive.

4. The print head of claim 1, further comprising a jet stack attached to a side of the ink reservoir opposite a side to which the filter plate is attached.

* * * * *